US007900693B2

(12) United States Patent
Rechea et al.

(10) Patent No.: US 7,900,693 B2
(45) Date of Patent: Mar. 8, 2011

(54) SOLDERED HEAT EXCHANGER, IN PARTICULAR A CONDENSER FOR MOTOR VEHICLES

(75) Inventors: Pedro Gonzales Rechea, Stuttgart (DE); Jean-Claude Meyer, Wiesviller (FR)

(73) Assignees: Behr GmbH & Co. KG, Stuttgart (DE); Behr Lorraine S.A.R.L., Hambach Cedex (FR)

( * ) Notice: Subject to any disclaimer, the term of this patent is extended or adjusted under 35 U.S.C. 154(b) by 177 days.

(21) Appl. No.: 10/590,487

(22) PCT Filed: Feb. 24, 2005

(86) PCT No.: PCT/EP2005/001955

§ 371 (c)(1), (2), (4) Date: Jun. 11, 2007

(87) PCT Pub. No.: WO2005/080903

PCT Pub. Date: Sep. 1, 2005

(65) Prior Publication Data

US 2008/0029259 A1 Feb. 7, 2008

(30) Foreign Application Priority Data

Feb. 24, 2004 (EP) ..... 04004129

(51) Int. Cl.
*F28F 9/04* (2006.01)

(52) U.S. Cl. ..... 165/178; 165/176

(58) Field of Classification Search ..... 165/173, 165/175, 176, 178

See application file for complete search history.

(56) References Cited

U.S. PATENT DOCUMENTS

| | | | |
|---|---|---|---|
| 5,632,332 | A | 5/1997 | Hanafusa |
| 6,557,373 | B1 | 5/2003 | Nitta |
| 2003/0173069 | A1 | 9/2003 | Nitta et al. |
| 2006/0096749 | A1 | 5/2006 | Bellott et al. |

FOREIGN PATENT DOCUMENTS

| | | | |
|---|---|---|---|
| DE | 196 45 502 | A1 | 5/1997 |
| EP | 0 915 304 | B1 | 5/1999 |
| EP | 1 158 261 | A2 | 11/2001 |
| EP | 1 443 294 | A1 | 8/2004 |

*Primary Examiner* — Teresa J Walberg
(74) *Attorney, Agent, or Firm* — Foley & Lardner LLP

(57) ABSTRACT

A soldered heat exchanger, in particular a condenser for motor vehicles which has at least one collector tube, and a flange which is secured to the collector tube and which is used to receive connection tubes. The flange can be fixed and soldered to the collection tube by one or two supports.

21 Claims, 3 Drawing Sheets

SOLDERED HEAT EXCHANGER, IN PARTICULAR A CONDENSER FOR MOTOR VEHICLES

Figure 1:
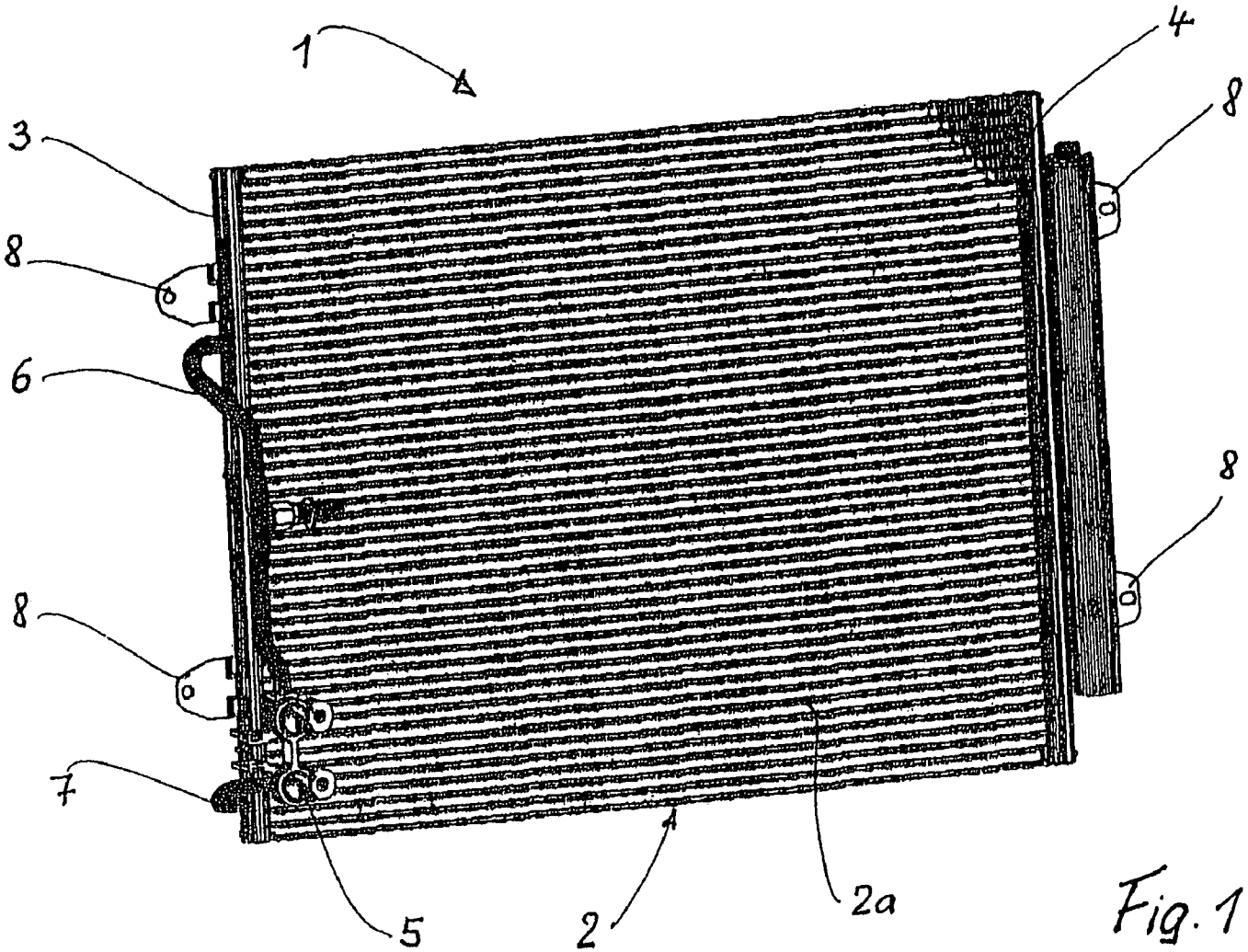

The invention relates to a soldered heat exchanger, in particular a condenser for motor vehicles, with at least one manifold and a flange which is secured to the manifold and is intended for receiving connecting tubes.

DE-A 196 45 502 discloses a refrigerant condenser of an air-conditioning system for motor vehicles, the condenser comprising a fin-tube block and laterally arranged manifolds. The known condenser also has a connection flange for the connection of refrigerant lines of a refrigerant circuit. The connection flange is connected to the fin-tube block of the condenser by means of a holding plate using rivets or screws. Arranged between the connection flange and a manifold is a connecting tube for the refrigerant inlet. On the other side, the connection flange is connected to a refrigerant outlet tube of the condenser. The connection flange secured to the condenser consequently represents the interface with respect to the refrigerant circuit of the motor vehicle. It is disadvantageous that the securement takes place by rivets or screws in the fin-tube block, which may lead to instances of damage or leakage. Furthermore, additional assembly steps are required for the securement of the holding plate on the fin-tube block. and the connection flange on the holding plate.

EP-A 0 915 304 discloses a condenser for a motor vehicle air-conditioning system with two separate connection flanges, which are secured to a manifold. In the case of this separate arrangement, it is disadvantageous that each flange has to be individually connected to the refrigerant inlet line and the refrigerant outlet line of the refrigerant circuit.

Refrigerant condensers of this type substantially comprise aluminum parts, which are soldered to one another to form a finished heat exchanger. The aim and at the same time the problem with soldering is that of positioning and fixing all the parts in relation to one another in such a way that they can be soldered in the soldering furnace without additional soldering aids or soldering devices or with as few such soldering devices as possible.

The earlier European patent application with the application number EP 03 290 190.2 describes a heat exchanger, in particular a soldered refrigerant condenser, with at least one manifold, to which a connection flange can be fixed and can be soldered. The connection flange is preferably produced by extrusion and has a one-piece holder, which grips around the manifold in a clamping manner and forms a soldering surface with it. At the same time, the connection flange is connected to the manifold by means of two connecting tubes for the refrigerant inlet and the refrigerant outlet. In this position, the condenser is soldered together with the connecting tubes and flange. It consequently has a common flange for the connection to a refrigerant inlet line and outlet line of a refrigerant circuit. As a result of the holder and flange being formed in one piece as an extruded part, the connection positions are limited.

On the basis of this earlier European patent application, it is the object of the present invention to make such a heat exchanger more flexible with regard to the flange arrangement, in order that the heat exchanger can be easily and reliably connected even in different connection positions.

This object is achieved by the features of patent claim 1, the flange being secured to the manifold by means of one or more holders, i.e. it being possible on the one hand for it to be fixed for the soldering operation and on the other hand for it to be soldered during the soldering operation. This achieves the advantage that the connection flange can be arranged in different positions in relation to the heat exchanger or condenser. The possibilities for variation of a holder, i.e. its arrangement on the manifold, its shape and size and the number of holders, allows the position of the connection flange to be variously changed and adapted to the connection conditions in the motor vehicle, the refrigerant inlet and outlet respectively forming a common connection flange.

In an advantageous refinement of the invention, the flange is arranged laterally offset with respect to the manifold or the block, comprising tubes and fins. This allows installation height or width to be saved when the condenser is installed. The lateral arrangement is achieved by the holders having holding arms which protrude transversely in relation to the manifold and on which the connection flange is held.

In an advantageous refinement of the invention, the connection flange has one or more holding attachments, which advantageously have guiding and holding grooves. This makes it possible to fit the connection flange onto the holder or holders or holding arms, position it and fix it. The holders themselves are inserted in corresponding slits in the manifold and caulked there by means of tabs (attachments on the holders). Consequently, the holders are also fixed with respect to the manifolds. Further fixing of the connection flange takes place by the connecting tubes, which on the hand are fitted in corresponding openings in the manifold and on the other hand are inserted in connecting openings in the flange.

In an advantageous refinement of the invention, the connection flange can be produced by extrusion or extrusion molding—by which the production costs can be lowered; however, the blank is subsequently machined, i.e. milled and drilled. It is consequently also possible to create deflections for the refrigerant within the flange by 90 degrees. The flange can, however, also be produced in the form of a blank by forging or casting.

Figure 2:
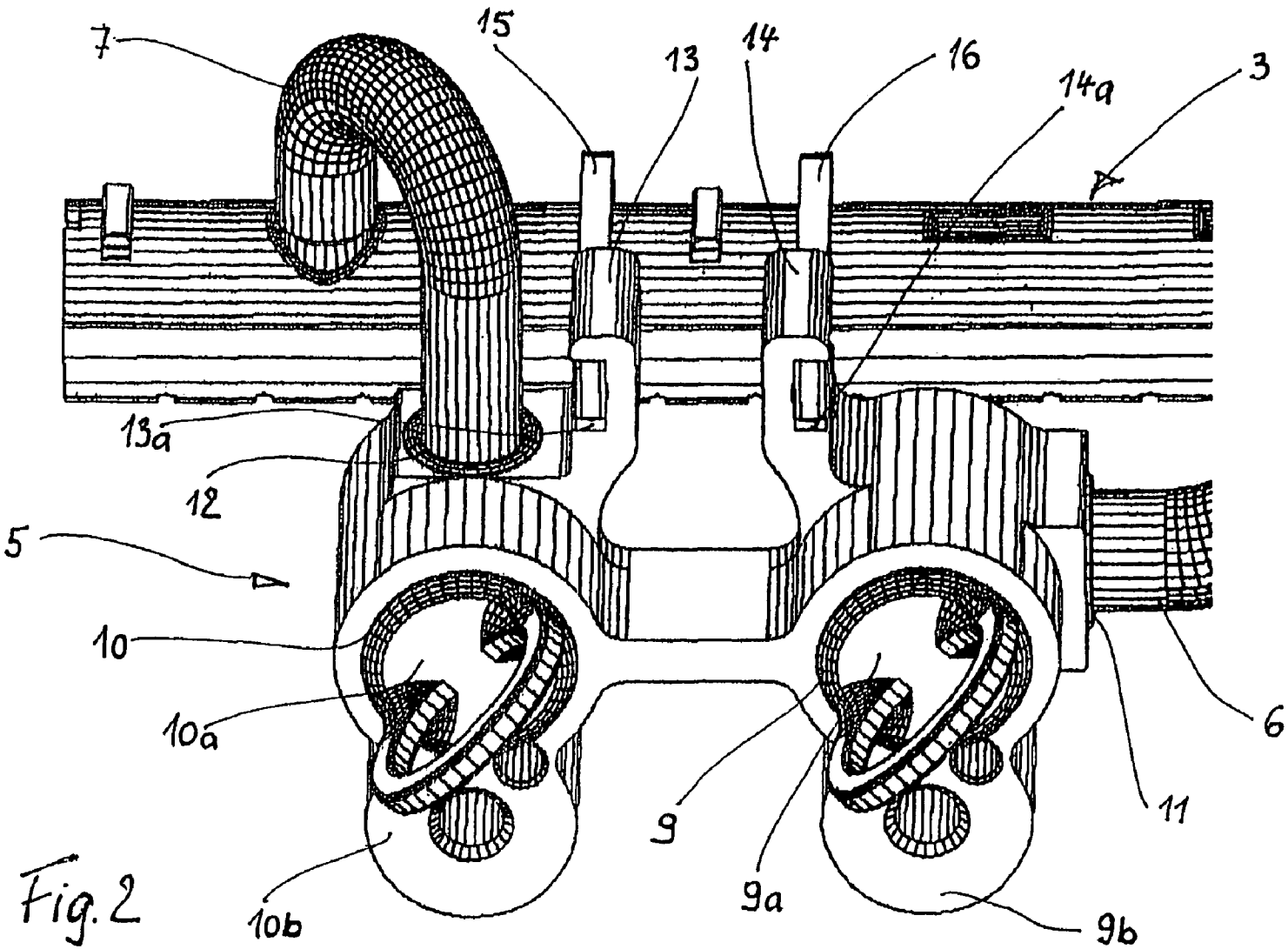
Figure 3:
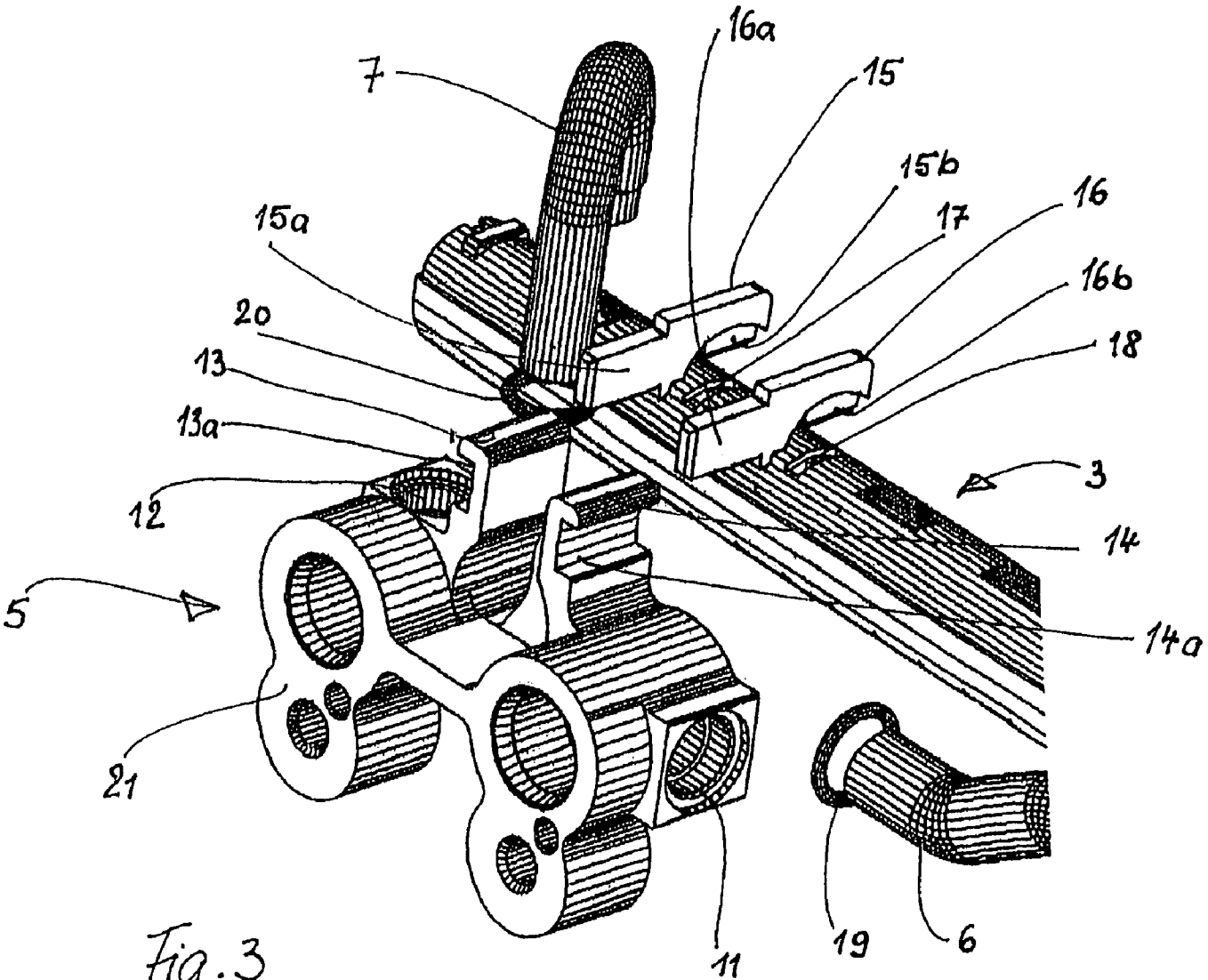

An exemplary embodiment of the invention is described in more detail below and represented in the drawing, in which:

FIG. 1 shows a condenser for an air-conditioning system of a motor vehicle with a connection flange, FIG. 2 shows the connection flange mounted, in an enlarged representation, and FIG. 3 shows the connection flange with the holders and manifold in an exploded representation.

FIG. 1 shows a condenser 1 of an air-conditioning system (not represented) for a motor vehicle. The condenser has a block 2, comprising flat tubes and corrugated fins not designated any more specifically, with an end face 2*a*, the flat tubes opening out with their ends into laterally arranged manifolds 3, 4. On the primary side, the condenser 1 is flowed through by refrigerant of a refrigerant circuit (not represented) and connected by means of a connection flange 5 to the refrigerant circuit. The connection flange 5 is connected to the upper part of the manifold 3 by means of a first connecting tube 6 for the inlet of the refrigerant and to the lower part of the manifold 3 by means of a second connecting tube 7 for the outlet of the refrigerant from the condenser 1. The condenser 1 is installed in the vehicle in the position represented, i.e. with the tubes arranged approximately horizontally or the manifolds 3, 4 arranged vertically, and secured there by means of butt straps 8.

FIG. 2 shows an enlarged detail from FIG. 1 with the connection flange 5, which is secured to the manifold 3. The connection flange 5 serves for connecting the condenser 1 on the refrigerant side to the refrigerant circuit (not represented) of the vehicle air-conditioning system, and consequently represents an interface. The flange 5 therefore has four openings for the refrigerant to pass through, to be specific a first connection opening 9 for the inlet of the refrigerant (from the refrigerant circuit) and a second connection opening 10 for the outlet of the refrigerant (into the refrigerant circuit), and also a connecting opening 11 for receiving the connecting tube 6 and a connecting opening 12 for receiving the connecting tube 7. The connecting tube 6 opens out into an inlet chamber (not represented any more specifically) of the manifold 3 and the connecting tube 7 opens out into an outlet chamber (likewise not designated any more specifically) of the manifold 3; the dividing of the manifolds into chambers by dividing walls is known from the prior art. The connection openings 9, 10 are closed by plugs 9*a*, 10*a* for the condenser 1 to be transported—they are removed when the condenser is connected to a mating flange (not represented) of the refrigerant circuit. The securing lugs 9*b*, 10*b* arranged next to the connection openings 9, 10 serve for securing the mating flange mentioned (not represented), which is generally a standard part. The connection flange 5 also has two holding attachments 13, 14 with guiding and holding grooves 13*a*, 14*a*. Secured to the manifold 3 are two holders 15, 16, which extend transversely in relation to the longitudinal direction of the manifold 3 and are received by the grooves 13*a*, 14*a* of the securing attachments 13, 14. The connection flange 5 is substantially fixed and—after the soldering—secured with respect to the manifold 3 by means of the holders 15, 16, additional fixing and securement also being provided by means of the two connecting tubes 6, 7.

FIG. 3 shows an exploded representation of the parts to be connected to one another before the soldering, to be specific the manifold 3, the two holders 15, 16, the two connecting tubes 6, 7 and the connection flange 5 with the securing attachments 13, 14. Otherwise, the same reference numerals as in FIGS. 1 and 2 are used. It can be seen from the representation in FIG. 3 (in conjunction with the representation in FIG. 2) that the connection flange 5 can be produced initially, i.e. as a blank, by extrusion. For example, the two holding attachments 13, 14 with their guiding and holding grooves 13*a*, 14*a* form typical extruded profiles, which however do not extend over the entire depth of the connection flange 5. The extruded blank of the connection flange 5 is therefore additionally subjected to machining such as drilling and milling—in order to obtain the form that can be seen from FIG. 3. The two holders 15, 16 are identically formed and have at their end facing the manifold 3 a downwardly directed attachment, a so-called tab 15*b*, 16*b*, and at their opposite end in each case a holding arm 15*a*, 16*a*. Arranged in the manifold 3, on its upper side, are two slits 16, 17, in which the tabs 15*a*, 16*a* of the holders 15, 16 are inserted and caulked from the inside. This achieves a fixing of the two holders 15, 16 with respect to the manifold 3. The connection flange 5 is fitted onto the holders 15, 16 fixed in this way, in that the holding arms 15*a*, 16*a* are inserted into the guiding and holding grooves 13*a*, 14*a*, to be precise up to a stop on the holder. After this step, the connecting tubes 6, 7 are inserted into corresponding openings (not designated any more specifically) of the manifold 3 and at the same time into the connecting openings 11, 12. Soldering rings 19, 20 are provided for the soldering of the connecting tubes 6, 7 in the openings 11, 12, while the holders 15, 16 are solder-plated on both sides, in order to solder them on the one hand to the manifold 3 and on the other hand to the connection flange 5. Once all the parts have been joined, positioned and fixed in the way described above, the entire condenser is brought into a soldering furnace (not represented) and soldered there in one operation. After that, the connection flange 5 is securely connected to the manifold 3, i.e. the condenser 1. The connecting tubes 6, 7 are tightly soldered both into the manifold 3 and into the connection flange 5 and the slits 17, 18 are sealed closed by soldering in the holders 15, 16. The connection flange 5 has a front planar connection face 21, which is aligned approximately parallel to the end face 2*a* (cf. FIG. 1) and is connected to a mating flange (not represented) for the connection to a refrigerant inlet line and outlet line.

The invention claimed is:

1. A heat exchanger assembly for a motor vehicle comprising:

at least one manifold, at least one holder, a flange secured to the manifold, wherein the holder and flange are separate pieces, wherein the flange includes at least one opening configured to receive a connecting tube, wherein the flange is configured to be joined to the manifold by the at least one holder, wherein the at least one holder includes a laterally protruding holding arm, wherein the flange has at least one holding attachment with at least one holding and guiding groove, wherein the groove comprises an interior surface and oppositely disposed sidewall surfaces, wherein a longitudinal direction of the interior surface of the holding and guiding groove extends transversely in relation to a longitudinal direction of the manifold, and wherein the holding and guiding groove is configured to receive the holding arm.

2. The heat exchanger assembly as claimed in claim 1, wherein the flange is arranged laterally offset with respect to the manifold.

3. The heat exchanger assembly as claimed in claim 1, wherein the at least one holder is secured to the manifold.

4. The heat exchanger assembly as claimed in claim 1, wherein the connecting tube is configured to be inserted into the manifold and into the flange, wherein the connecting tube can be soldered to the manifold and to the flange.

5. The heat exchanger assembly as claimed in claim 1, wherein the flange has two holding attachments and is connected to the manifold by two holders arranged parallel to one another.

6. The heat exchanger assembly as claimed in claim 1, wherein the flange has a connection face and the heat exchanger has an end face, wherein the connection face and the end face are arranged approximately parallel to one another.

7. The heat exchanger assembly as claimed in claim 6, wherein the flange has two connection openings arranged next to one another in the connection face.

8. The heat exchanger assembly as claimed in claim 1, wherein the flange is produced as a blank by extrusion or extrusion molding.

9. The heat exchanger assembly as claimed in claim 1, wherein the flange is produced as a blank by casting or drop-forging.

10. The heat exchanger assembly as claimed in claim 1, wherein the heat exchanger includes a block comprising tubes and fins, wherein the heat exchanger is configured to be soldered in complete form with the at least one manifold, the connecting tube, the at least one holder, and the flange.

11. The heat exchanger assembly of claim 1, wherein the flange comprises four openings in which the at least one opening is one of said openings.

12. The heat exchanger assembly of claim 11, wherein a first opening is the at least one opening, wherein a second opening is configured to engage an end of a tube, wherein a third of said four openings is configured as an inlet of a refrigerant circuit, and wherein a fourth of said four openings is configured as an outlet of the refrigerant circuit.

13. The heat exchanger assembly of claim 1, wherein the flange and manifold are soldered together.

14. The heat exchanger assembly of claim 1, wherein the assembly further comprises another connecting tube.

15. The heat exchanger assembly of claim 1, wherein the flange comprises another opening, wherein the another opening is configured to engage with a tube.

16. The heat exchanger assembly of claim 1, wherein the at least one opening is configured to engage with an end of the connection tube such that the flange forms an interface with an end of the connection tube for fluid flow from the end of the connection tube.

17. The heat exchanger assembly of claim 1, wherein the at least one holder is caulked to the manifold.

18. The heat exchanger assembly of claim 1, wherein the flange comprises at least four openings, wherein a first of said at least four openings is the at least one opening and a second of said at least four openings is configured to engage an end of a tube, and a third and a fourth of said at least four openings are each closed by a plug.

19. The heat exchanger assembly of claim 1, wherein the flange comprises at least four openings, wherein a first of said at least four openings is the at least one opening and a second of said at least four openings is configured to engage an end of a tube, wherein a third of said at least four openings is configured as an inlet of a refrigerant circuit, wherein a fourth of said at least four openings is configured as an outlet of the refrigerant circuit, and wherein the flange further comprises at least one securing lug arranged adjacent each of the third and fourth openings.

20. The heat exchanger assembly of claim 1, wherein the at least one holder comprises a pair of holders, wherein the at least one holding and guiding groove comprises a pair of holding and guiding grooves, and wherein the interior surfaces of the pair of holding and guiding grooves face in opposite directions.

21. The heat exchanger assembly of claim 1, wherein the at least one holder comprises a pair of holders, and wherein each holder comprises a downwardly directed tab inserted into a respective slit formed in the manifold.

* * * * *